US007317283B2

(12) United States Patent
Fujita

(10) Patent No.: US 7,317,283 B2
(45) Date of Patent: Jan. 8, 2008

(54) PHOTOMULTIPLIER

(75) Inventor: Toshikazu Fujita, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 11/294,534

(22) Filed: Dec. 6, 2005

(65) Prior Publication Data

US 2006/0220553 A1 Oct. 5, 2006

Related U.S. Application Data

(60) Provisional application No. 60/666,567, filed on Mar. 31, 2005.

(51) Int. Cl.
*H01J 43/18* (2006.01)

(52) U.S. Cl. ..... 313/533; 313/532; 313/534; 313/536

(58) Field of Classification Search ..... 313/532, 313/523, 103, 399, 538, 533, 104, 534, 105, 313/535, 536, 537, 308
See application file for complete search history.

(56) References Cited

U.S. PATENT DOCUMENTS

| | | | | | |
|---|---|---|---|---|---|
| 2,818,520 | A | * | 12/1957 | Engstrom et al. | 313/534 |
| 2,866,914 | A | | 12/1958 | Lallemand | |
| 3,114,044 | A | * | 12/1963 | Sternglass | 250/207 |
| 3,873,867 | A | * | 3/1975 | Girvin | 313/534 |
| 4,125,793 | A | * | 11/1978 | Timan | 313/536 |
| RE30,249 | E | * | 4/1980 | Faulkner | 313/104 |
| 4,396,859 | A | | 8/1983 | Butterwick | |
| 4,431,943 | A | * | 2/1984 | Faulkner et al. | 313/533 |
| 4,439,712 | A | * | 3/1984 | Butterwick | 313/533 |
| 4,570,102 | A | * | 2/1986 | McDonie et al. | 313/533 |
| 4,575,657 | A | | 3/1986 | Kaiser | |
| 4,593,229 | A | | 6/1986 | McDonie et al. | |
| 4,990,827 | A | * | 2/1991 | Ehrfeld et al. | 313/533 |
| 5,363,014 | A | | 11/1994 | Nakamura | 313/533 |
| 5,598,061 | A | * | 1/1997 | Nakamura et al. | 313/532 |
| 5,744,908 | A | * | 4/1998 | Kyushima | 313/533 |
| 5,789,861 | A | * | 8/1998 | Kyushima et al. | 313/533 |

(Continued)

FOREIGN PATENT DOCUMENTS

| | | |
|---|---|---|
| EP | 0 539 229 | 4/1993 |

(Continued)

*Primary Examiner*—Sikha Roy
*Assistant Examiner*—Brian T Schoolman
(74) *Attorney, Agent, or Firm*—Drinker Biddle & Reath LLP

(57) ABSTRACT

The present invention relates to a photomultiplier having a structure for performing a high gain and achieving a higher productivity in a state keeping or improving an excellent high-speed response. In the photomultiplier, an electron-multiplying unit accommodated in a sealed container has a structure that enables an integrated assembly of a focusing electrode, an accelerating electrode, a dynode unit, and an anode. Specifically, the focusing electrode has one or more notched portions to be grasped by a part of each of the insulating support members for grasping directly the dynode unit and so on when the focusing electrode itself is rotated around the tube axis of the sealed container. With this construction, the focusing electrode is fixed to the pair of insulating support members in a state that the focusing electrode is aligned with high accuracy by using the pair of insulating support member as a reference member.

6 Claims, 11 Drawing Sheets

U.S. PATENT DOCUMENTS

| | | | | |
|---|---|---|---|---|
| 5,841,231 | A * | 11/1998 | Kimura et al. | 313/532 |
| 6,946,792 | B2 * | 9/2005 | Kimura et al. | 313/532 |
| 2003/0122483 | A1 * | 7/2003 | Ishizu et al. | 313/533 |
| 2004/0100193 | A1 * | 5/2004 | Kato et al. | 313/532 |
| 2006/0038473 | A1 * | 2/2006 | Mochizuki et al. | 313/373 |
| 2006/0220555 | A1 | 10/2006 | Fujita | |

FOREIGN PATENT DOCUMENTS

| | | |
|---|---|---|
| GB | 2 050 048 | 12/1980 |
| JP | A-5-114384 | 5/1993 |
| JP | A-8-050877 | 2/1996 |
| JP | 9-180670 | 7/1997 |
| JP | 10-214588 | 8/1998 |

* cited by examiner 250a
210
200
250b
310
300
320
410a
DY1
DY1a
DY2a
DY2
DY2b
DY3
DY1b
DY3a
DY3b
DY4a
DY4
DY4b
DY5a
DY5
DY5b
DY6a
DY6
DY6b
DY7a
DY7
DY7b
DY8a
DY8
DY8b
450c
410b
400
420b
420d
420
450b
450a

PHOTOMULTIPLIER

CROSS-REFERENCE TO RELATED APPLICATION

This application claims priority to Provisional Application No. 60/666,567 filed on Mar. 31, 2005, by the same Applicant, which is hereby incorporated by reference in its entirety.

BACKGROUND OF THE INVENTION

1. Field of the Invention

The present invention relates to a photomultiplier that enables a cascade-multiplication of secondary electrons by emitting sequentially the secondary electrons through a plurality of stages in response to incidence of photoelectrons.

2. Related Background Art

In recent years, developments of TOF-PET (Time-of-Flight-PET) are earnestly proceeding as a PET (Positron-Emission Tomography) apparatus for the next generation in the field of nuclear medicine. In particular, in the TOF-PET apparatus, two gamma rays emitted from a radioactive isotope administered in a body are simultaneously measured, and therefore a photomultiplier with a large capacity having an excellent high-speed response is employed for the detectors arranged so as to surround a subject.

For example, a photomultiplier shown in JP-A-5-114384 is known as the aforementioned one. In the conventional photomultiplier has a construction such that a focusing electrode and an accelerating electrode are arranged in this turn from a cathode toward a first-stage dynode. In this case, the focusing electrode is the one correcting an orbit of each photoelectron emitted from the cathode such that the photoelectrons may be focused on the first-stage dynode. In addition, the accelerating electrode is the one accelerating the photoelectrons emitted from the cathode to the first-stage dynode, and has a function to reduce variations in transit time from the cathode to the first-stage dynode caused by the emission area of the photoelectrons of the cathode.

A photomultiplier with an excellent high-speed response can be obtained by the configuration arranging the focusing electrode and accelerating electrode between the cathode and the first-stage dynode, as mentioned above.

SUMMARY OF THE INVENTION

The inventors have studied the foregoing prior art in detail, and as a result, have found problems as follows.

Namely, in the conventional photomultiplier, an electron-multiplying unit housed in a sealed container and performing an excellent high-speed response is constructed by a dynode unit such that a plurality of stages of dynodes together with an anode are sandwiched between a pair of insulating fixing plates, a focusing electrode, and an accelerating electrode. In the assembly work, the accelerating electrode is fixed to the dynode unit by a specific metal member, while the focusing electrode is fixed to the accelerating electrode through a glass member. In the photomultiplier including the thus assembled electron-multiplying unit, a high positional accuracy is required for fixings of the focusing electrode and accelerating electrode to perform a high-speed response of the photomultiplier.

However, the fixing of the focusing electrode to the accelerating electrode is carried out such that the two ends of the glass material are fixed by welding at the fixing area extending from the focusing electrode and the fixing area extending from the accelerating electrode, respectively. For this reason, the fixing work of the focusing electrode is a work involving a high level of difficulty such that some experience for the worker himself is required. In addition, because the number of steps for assembling the whole electron-multiplying unit may be increased, upon mass-production of the multiplier, it is difficult to shorten the producing time and reduce variations in performance thereof.

The present invention is made to solve the aforementioned problem, and in order to perform a high gain and achieve a higher productivity in a state keeping or improving a high-speed response, it is an object to provide a photomultiplier having a structure which enables an integrated assembly of an electron-multiplying unit including a focusing electrode and an accelerating electrode, that is, a structure preferred to the mass-production.

A photomultiplier according to the present invention comprises a sealed container of which the inside is kept in a vacuum state, and a cathode, a focusing electrode, an accelerating electrode, a dynode unit, and an anode each to be accommodated in the sealed container. In addition, the dynode unit and anode are unitedly held in a state sandwiched by a pair of insulating support members. The cathode emits photoelectrons as first electrons within the sealed container in response to incidence of light having a predetermined wavelength. The dynode unit includes a plurality of stages of dynodes for emitting secondary electrons in response to the photoelectrons reached from the photocathode to cascade-multiply sequentially the photoelectrons. The anode takes out the secondary electrons cascade-multiplied by the dynode unit as a signal. The focusing electrode functions to correct the orbit of each photoelectron emitted from the photocathode, and is arranged between the photocathode and dynode unit. Furthermore, the focusing electrode has a through hole through which the photoelectrons from the photocathode pass. The accelerating electrode functions to accelerate the photoelectrons reached from the photocathode via the focusing electrode, and is arranged between the focusing electrode and dynode unit. Also, the accelerating electrode has a through hole through which the photoelectrons reached from the photocathode via the focusing electrode pass.

In particular, in the photomultiplier according to the present invention, the focusing electrode has one or more notched portions to be grasped by a pair of each of the pair of insulating support members when the focusing electrode itself rotates around the tube axis of the sealed container. Note that the notched portions are arranged along the edge portion defining the through hole in the focusing electrode.

As a specific structure of the focusing electrode, for instance, it is preferable that the pair of insulating support members each have one or more protruding portions extending toward the photocathode, at least serving as a reference of the arranged position of the focusing electrode. In addition, the protruding portions each have a fixture structure for fixing the focusing electrode in a state of supporting directly the focusing electrode. In this case, each of the protruding portions is arranged at a predetermined position to be at least surrounded by the through hole of the focusing electrode in a state of grasping the dynode and anode.

As described above, in the photomultiplier, when the protruding portions (attached with the fixture structure) at least serving as a reference of the arranged position of the focusing electrode is respectively provided on the pair of insulating support members for holding the dynode unit and anode, the focusing electrode may be fixed unitedly to the pair of insulating support members, together with the dynode unit and anode. In other words, due to the structure fixing the focusing electrode, provided at a part of the pair of insulating support members for grasping unitedly the dynode unit and anode, the focusing electrode constructing a part of the electron-multiplying unit can be easily aligned by using the pair of insulating support members as a reference member. As a result, on assembly of the electron-multiplying unit, alignment work with high precision between the members, specific fixing members and fixing jigs becomes unnecessary, which enables to improve drastically the productivity of the electron-multiplying unit accommodated in the sealed container. Furthermore, variations in performance between produced photomultipliers can be reduced irrespective of skilled degree of workers themselves.

In addition, it is preferable that each fixture structure provided at the protruding portions includes a slit groove for pinching a part of the edge portion of the through hole of the focusing electrode. In this case, it is preferable that the notched portions each are constituted by an introducing area for accommodating the protruding portions through the through hole of the focusing electrode, and a fixing area for restricting the rotation of the focusing electrode around the tube axis of the sealed container.

Besides, it is preferable that the focusing electrode further has one or more reinforcing members prepared with a slit groove for pinching one of the protruding portions. In this case, the reinforcing members are welded to the focusing electrode in a state of pinching a part of each protruding portions by the slit groove of the reinforcing member. Thus, when the part of the focusing electrode is pinched by the slit groove corresponding to the part of the focusing electrode, alignment work and fixing work of the focusing and accelerating electrodes can be carried out simultaneously.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, embodiments of a photomultiplier according to the present invention will be explained in detail with reference to FIGS. 1 to 11. In the explanation of the drawings, constituents identical to each other will be referred to with numerals identical to each other without repeating their overlapping descriptions.

Figure 1:
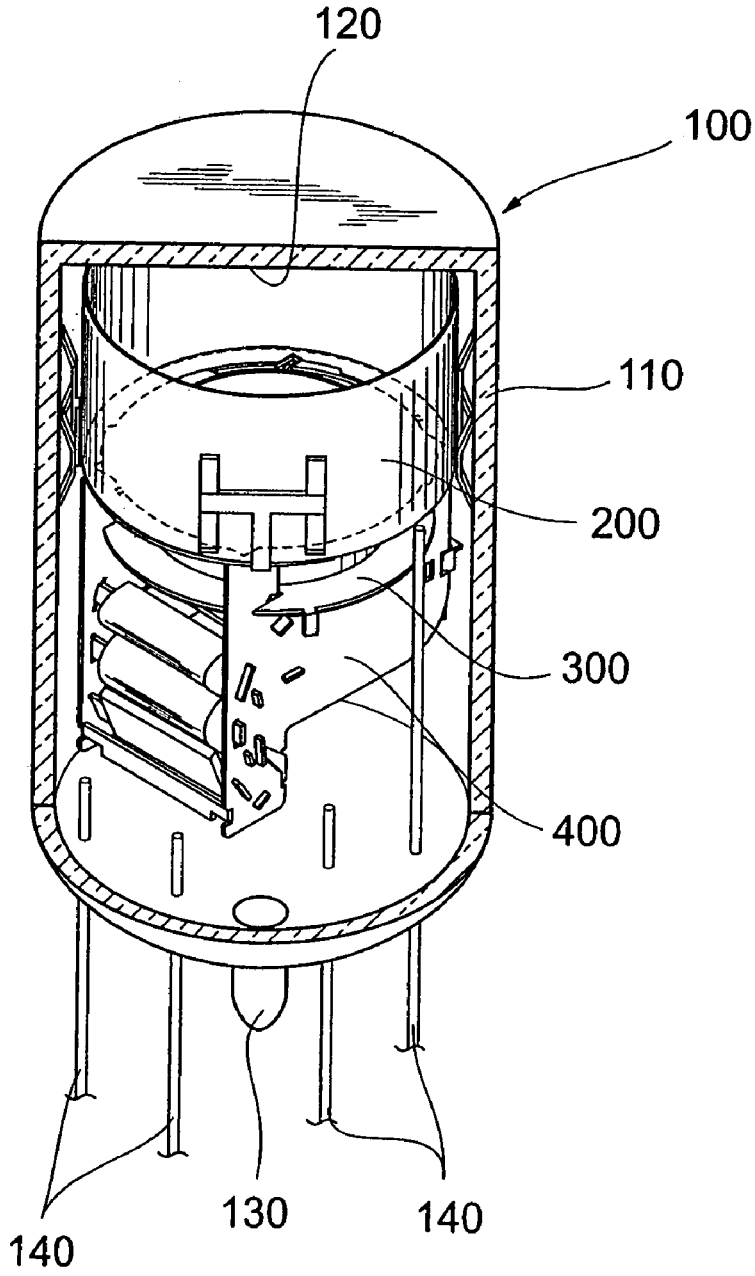
FIG. 1 is a partially cutaway view illustrating a schematic structure of a photomultiplier of a first embodiment according to the present invention.

FIG. 1 is a partially cutaway view illustrating a schematic structure of a photomultiplier of an embodiment according to the present invention.

As shown in FIG. 1, a photomultiplier 100 includes a sealed container 110 provided with a pipe 130 (solidified after evacuation) for evacuating the inside at the bottom thereof, a cathode 120 provided in the sealed container 110 and an electron-multiplying unit.

The sealed container 110 is constituted by a cylindrical body having a face plate, the inside of which is formed with a cathode 120, and a stem supporting a plurality of lead pins 140 in their penetrating state. The electron-multiplying unit is held at a predetermined position within the sealed container 110 by the lead pins 140 extending from the stem to the inside of the sealed container 110.

The electron-multiplying unit is constituted by a focusing electrode 200, an accelerating electrode 300, and a dynode unit 400 disposing an anode thereinside. The focusing electrode 200 is an electrode correcting an orbit of each photoelectron emitted from the cathode 120 such that the photoelectrons may be focused to the dynode unit 400, and has a through hole which is arranged between the cathode 120 and dynode unit 400 and through which the photoelectrons from the cathode 120 pass. In addition, the accelerating electrode 300 is an electrode accelerating the photoelectrons emitted from the cathode 120 to the dynode unit 400, and has a through hole that is arranged between the focusing electrode 200 and dynode unit 400 such that the photoelectrons passed through the through hole of the focusing electrode can be further accelerated toward the dynode unit 400. Due to the accelerating electrode 300, a variation in transit time of the photoelectrons reached from the cathode 120 to the dynode unit 400 can be reduced, though it is caused by the photoelectrons emitting area of the cathode 120. Furthermore, the dynode unit 400 includes a plurality of stages of dynodes cascade-multiplying sequentially secondary electrons emitted in response to the photoelectrons reached from the cathode 120 through the focusing electrode 200 and accelerating electrode 300, an anode taking out the secondary electrons cascade-multiplied by means of these plurality of stages of dynodes, and a pair of insulating support members grasping unitedly these plurality of stages of dynodes and the anode.

Figure 2:
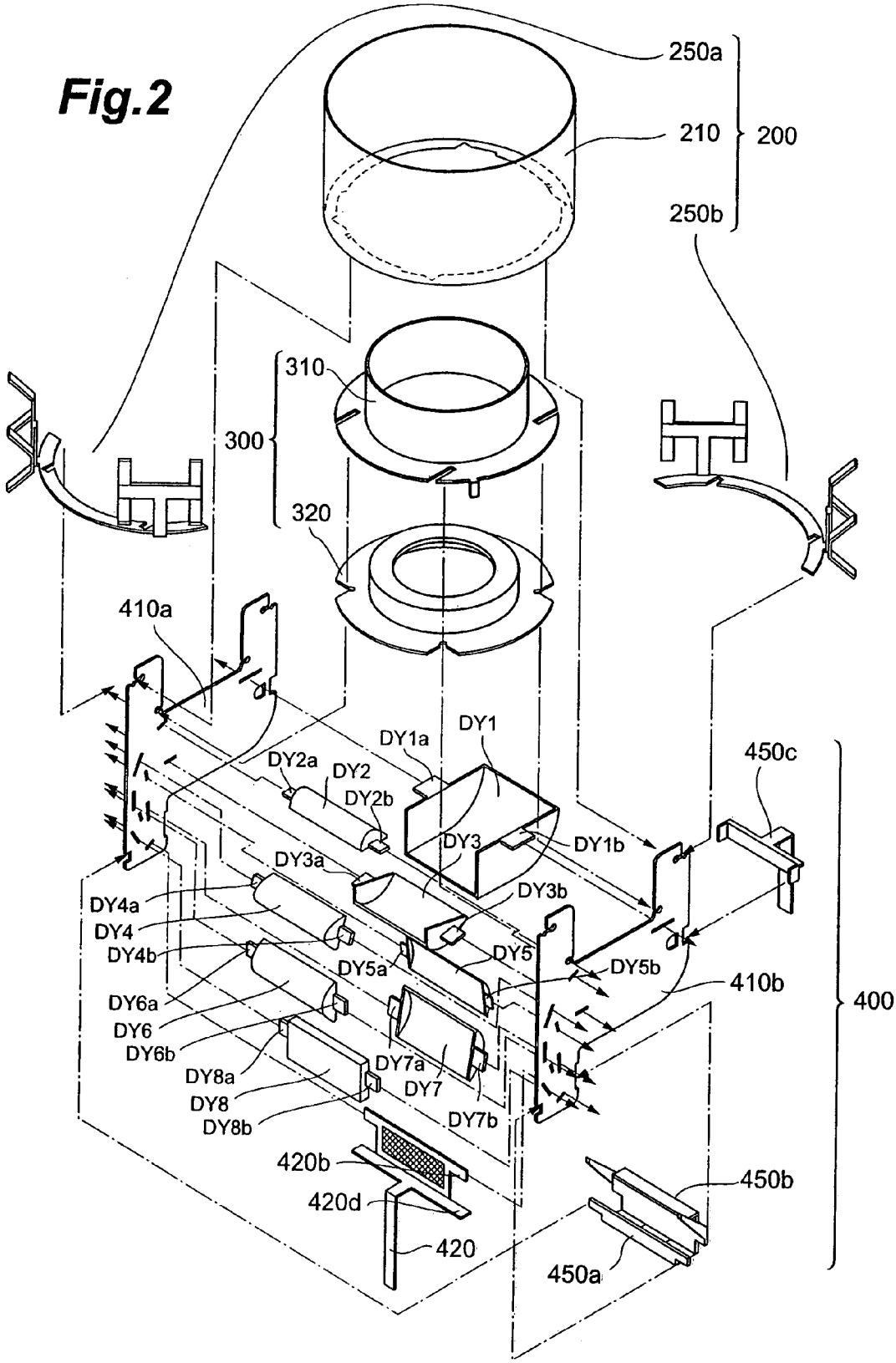
FIG. 2 is an assembly process view for explaining the construction of an electron-multiplying unit applied to the photomultiplier according to the present invention.

FIG. 2 is an assembly process view for explaining the construction of the electron-multiplying unit applied to the photomultiplier according to the present invention.

As shown in FIG. 2, the electron-multiplying unit is constituted by the focusing electrode 200, accelerating electrode 300, and dynode unit 400 including the anode. The focusing electrode 200 is provided with a through hole through which the photoelectrons from the cathode 120 pass. The accelerating electrode 300 is constituted by an upper electrode 310 and a lower electrode 320 to improve an assembling efficiency of the electron-multiplying unit. These upper electrode 310 and lower electrode 320 are integrated by welding at several spots during the assembly work of the electron-multiplying unit. The dynode unit 400 is constituted by first to seventh dynodes DY1-DY7 each grasped by the first and second insulating support members 410*a*, 410*b*, an anode 420, and a reflection-type dynode DY8 reversing the electrons passed through the anode 420 toward the anode 420 again. In addition, in each of the first to seventh dynodes DY1-DY7 and the reflection-type dynode DY8, a reflection-type emission surface of secondary electrons is formed by receiving photoelectrons or secondary electrons to emit newly secondary electrons toward the incident direction of the electrons. In addition, fixed pieces DY1*a*, DY1*b* are provided to be grasped by the first and second insulating support members 410*a*, 410*b* at the two ends of the first dynode DY1. Similarly, the second dynode DY2 has fixed pieces DY2*a*, DY2*b* at its two ends; the third dynode DY3 has fixed pieces DY3*a*, DY3*b* at its two ends; the fourth dynode DY4 has fixed pieces DY4*a*, DY4*b* at its two ends; the fifth dynode DY5 has fixed pieces DY5*a*, DY5*b* at its two ends; the sixth dynode DY6 has fixed pieces DY6*a*, DY6*b* at its two ends; the seventh dynode DY7 has fixed pieces DY7*a*, DY7*b* at its two ends; the anode 420 has fixed pieces 420*a*-420*d* at its two ends; and the eighth dynode DY8 has fixed pieces DY8*a*, DY8*b* at its two ends.

The lower electrode 320 of the accelerating electrode 300 is grasped by the first and second insulating support members 410*a*, 410*b* together with the first to seventh dynodes DY1-DY7, anode 420, and reflection-type dynode DY8. Thus, the upper electrode 310 is fixed by welding at the lower electrode 320 in a grasped state by the first and second insulating support members 410*a*, 410*b*. On the other hand, the focusing electrode 200 is mounted at the protruding portions provided at the upper portions (cathode 120 side) of the first and second insulating support members 410*a*, 410*b*, and fixed at the first and second insulating support members 410*a*, 410*b* by welding of reinforcing members 250*a*, 250*b*.

In addition, as described above, in a state that the first to seventh dynodes DY1-DY7, anode 420, and reflection-type dynode DY8 are unitedly grasped, the first and second insulating support member 410*a*, 410*b* are further grasped by metal clips 450*a*-450*c*; thus, the aforementioned members are stably held by the first and second insulating support members 410*a*, 410*b*.

Figure 3:
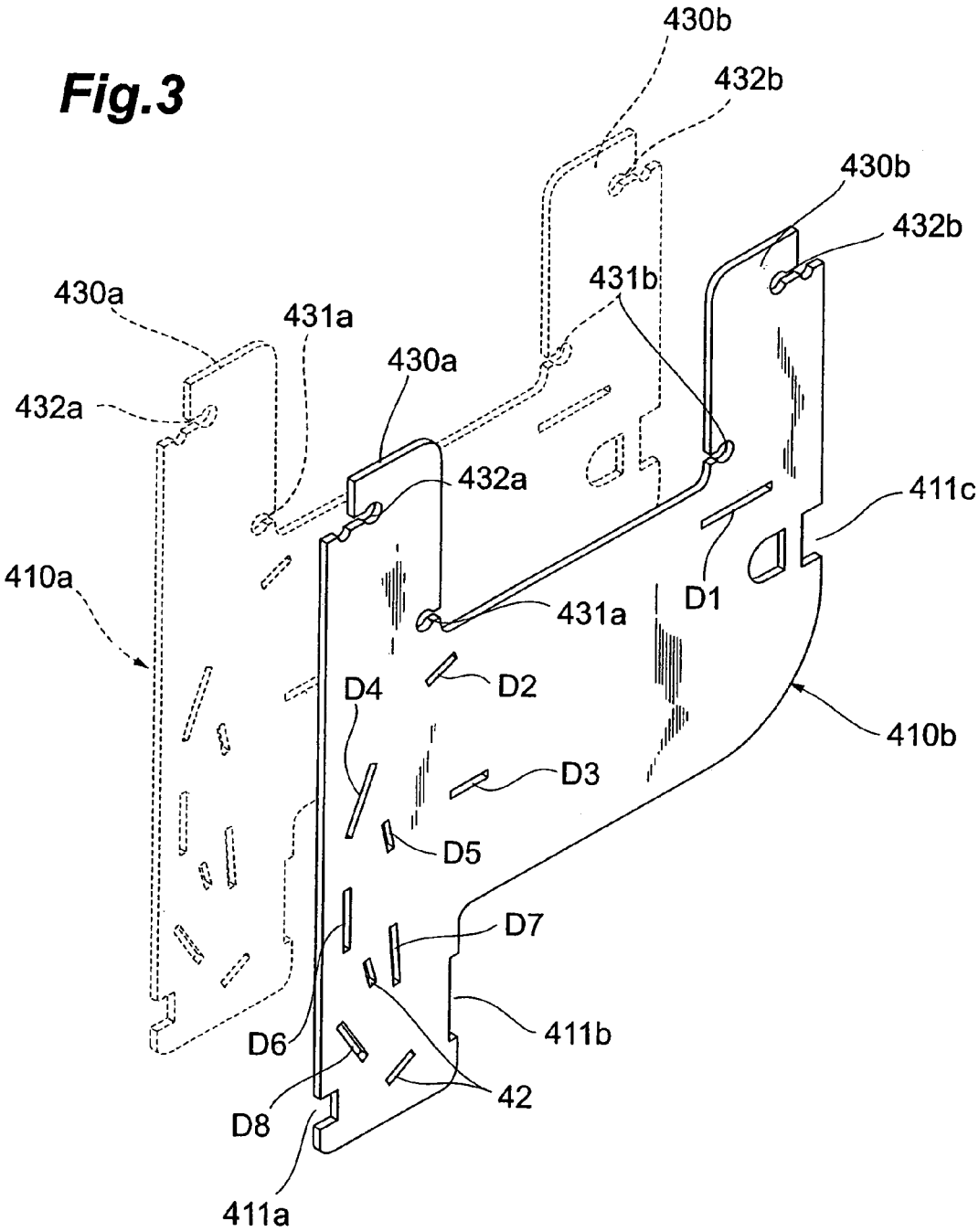
FIG. 3 is a view for explaining the structure of a pair of insulating support members constructing a part of the electron-multiplying unit.

FIG. 3 is a view for explaining the structure of the first and second insulating support members 410*a*, 410*b* constituting a part of the electron-multiplying unit. In this case, since the first and second insulating support members 410*a*, 410*b* have the same structure, only the second insulating support member 410*b* will now be explained for their common structure description below.

The insulating support member 410*b* is provided with alignment holes D1-D8 and 42 to be inserted by fixed pieces DY1*b*-DY8*b*, 420*b* of the first to seventh dynodes DY1-DY7, anode 420, and reflection-type dynode DY8. Also, the insulating support member 410*b* is provided with notched portions 411*a*-411*c* hooking the metal clips 450*a*-450*c* in order to easily secure to the insulating support member 410*a* grasping the members DY1-DY8, 420 together.

In particular, protruding portions 430*a*, 430*b* extending upwardly are provided at the insulating support member 410*b*. Namely, the protruding portions 430*a*, 430*b* extend toward the cathode side when the electron-multiplying unit is mounted in the sealed container 110. Then, at the protruding portion 430*a*, a slit groove 431*a* for aligning and fixing the accelerating electrode 300 as a first fixture structure, and a slit groove 432*a* for aligning and fixing the focusing electrode 200 as a fixture structure are provided. Similarly, at the protruding portion 430*b*, a slit groove 431*b* for aligning and fixing the accelerating electrode 300 as a first fixture structure, and a slit groove 432*b* for aligning and fixing the focusing electrode 200 as a fixture structure are provided.

Figure 4:
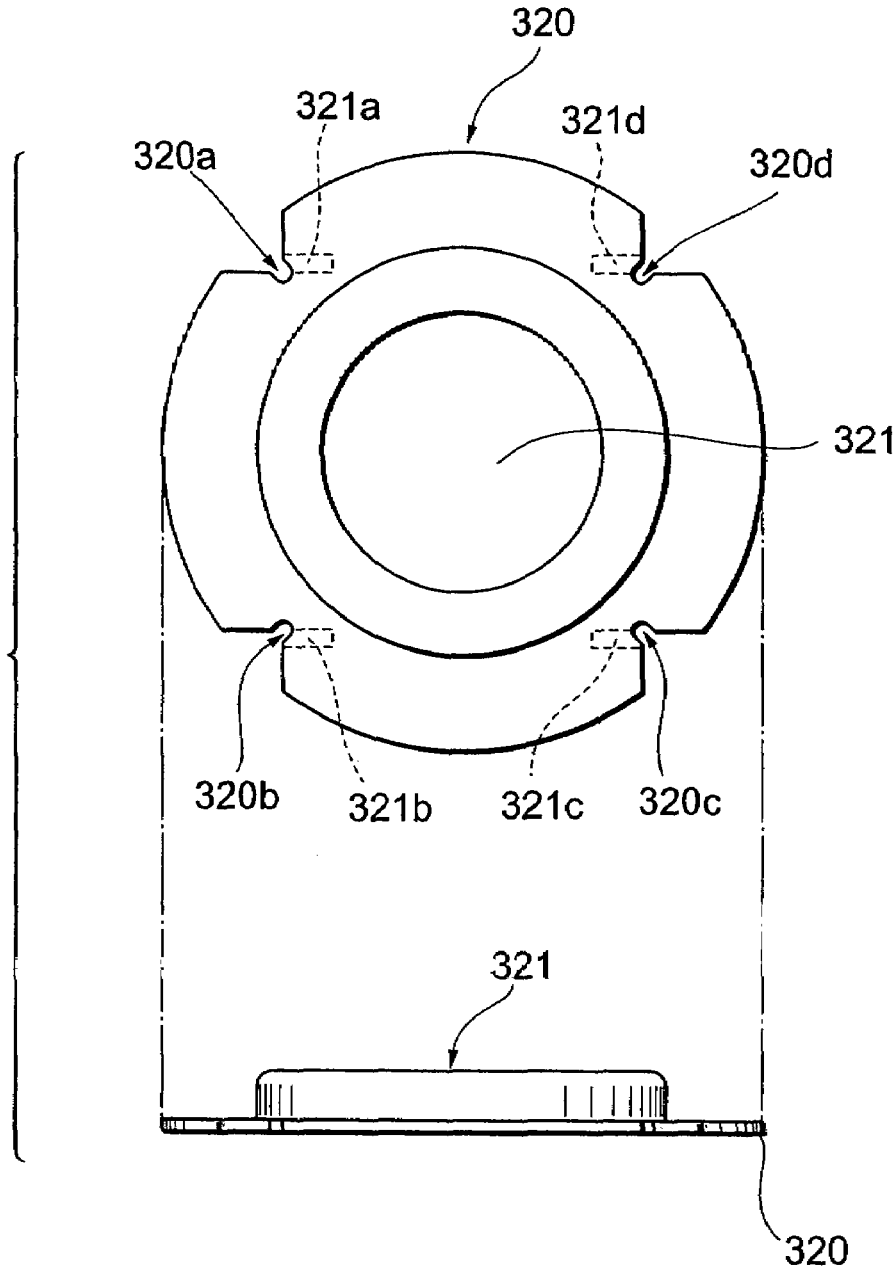
FIG. 4 is a plan view and a side view for explaining the structure of a lower electrode in an accelerating electrode.

Next, the structure of the accelerating electrode 300 will be explained with reference to FIG. 4 and FIG. 5. FIG. 4 is a plan view and a side view for explaining the structure of the lower electrode 320 constituting a part of the accelerating electrode 300. Also, FIG. 5 is a plan view and a side view for explaining the structure of the upper electrode 310 constituting a part of the accelerating electrode 300.

Figure 5:
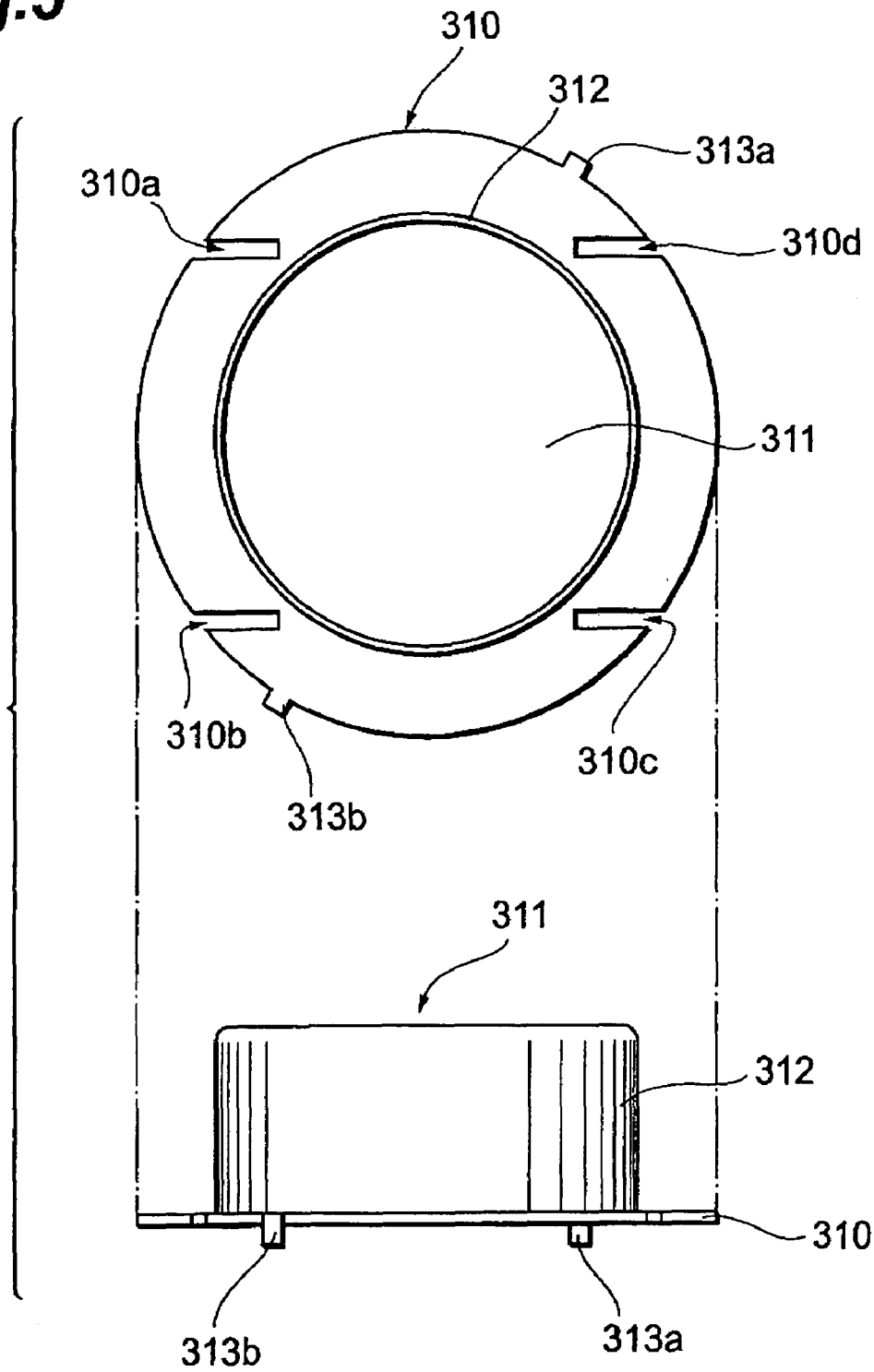
FIG. 5 is a plan view and a side view for explaining the structure of an upper electrode in the accelerating electrode.

The accelerating electrode 300 can be obtained by welding at several spots of the lower electrode 320 and upper electrode 310 having the structures as shown in FIGS. 4 and 5. The lower electrode 320 is directly inserted and fixed in the slit grooves 431*a*, 431*b*, which are provided at the respective protruding portions 430*a*, 430*b* of the first and second insulating support members 410*a*, 410*b*.

Specifically, as shown in FIG. 4, the lower electrode 320 is provided with notched portions 320*a*-320*d* to be grasped to the first and second insulating support members 410*a*, 410*b* together with the first to seventh dynodes DY1-DY7, anode 420, and reflection-type dynode DY8. In addition, at the flange portion located at the outer periphery of a through hole 321 provided at the accelerating electrode 320, the notched portions 320*a*-320*d* are arranged to surround the through hole 321. On the other hand, as shown in FIG. 5, the upper electrode 310 is constituted by a body unit 312 defining a through hole 311 and a flange portion at one open end of the body unit 311. At the outer periphery of the flange portion, slit grooves 310*a*-310*d* to sandwich the protruding portions 430*a*, 430*b* provided on each of the first and second insulating support members 410*a*, 410*b* are formed, and fixing section 313*a*, 313*b* to be fixed by welding to the lower electrode 320 are provided.

Figure 6:
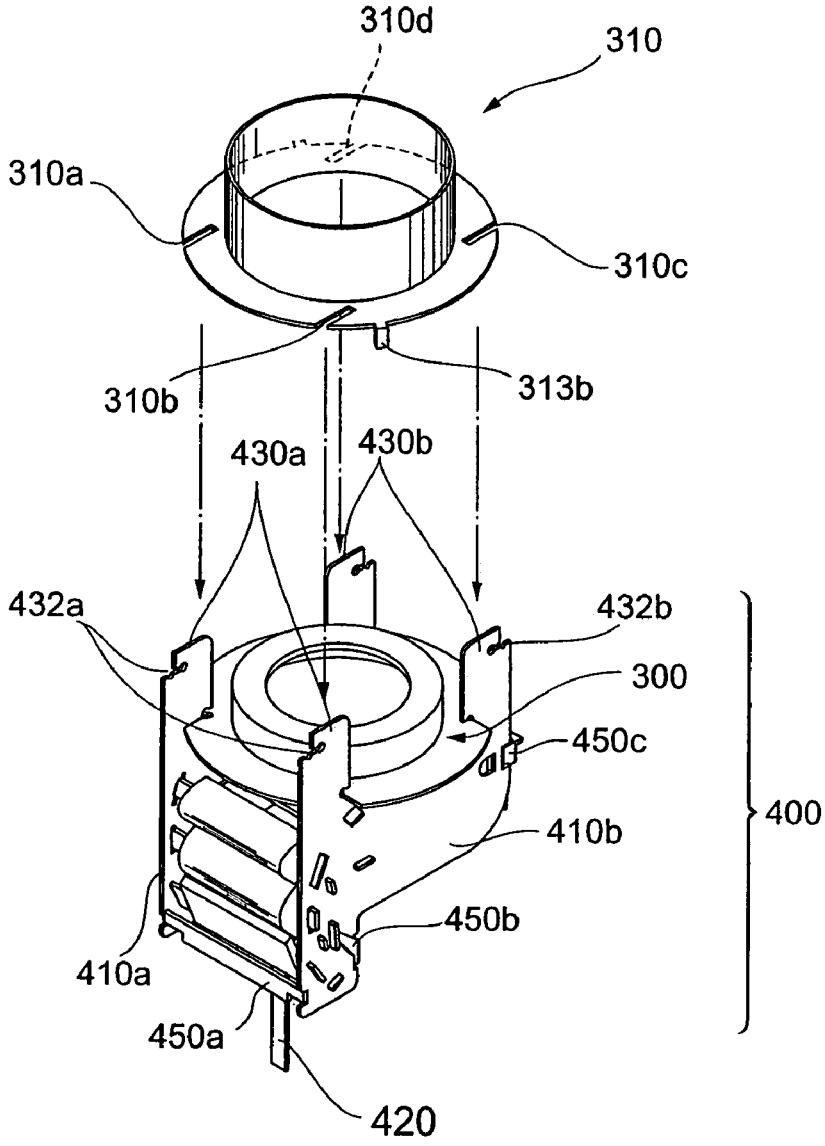
FIG. 6 is a view for explaining a mounting process of the accelerating electrode to the pair of insulating support members.

The lower electrode 320 and upper electrode 320 having the aforementioned structure, as shown in FIG. 6, are fixed in a welded state to the first and second insulating support members 410*a*, 410*b* arranged to oppose each other.

Figure 7:
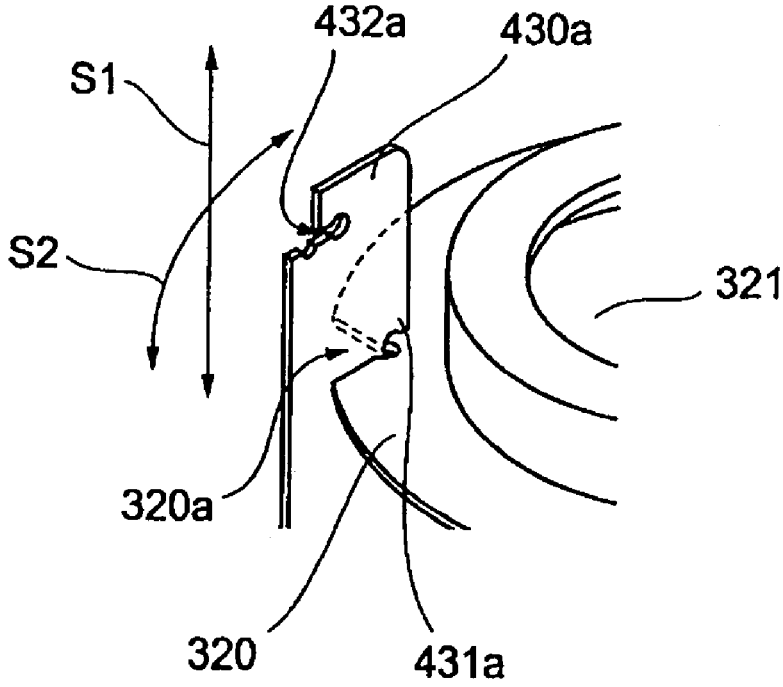
FIG. 7 is an enlarged view for explaining the mounting process of FIG. 6 in further detail.

First, the lower electrode 320 is grasped by the first and second insulating support members 410*a*, 410*b* with the first to seventh dynodes DY1-DY7, anode 420, and reflection-type dynode DY8. At this time, the lower electrode 320 is grasped by the first and second insulating support members 410*a*, 410*b* in a state that areas (parts corresponding to regions 321*a*-321*d* shown in FIG. 4) provided with the notched portions 320*a*-320*d* of the flange portion are fit in the slit grooves 431*a*, 431*b* formed at the protruding portions 430*a*, 430*b*, respectively. As a result, the lower electrode 320 is fixed to the first and second insulating support members 410*a*, 410*b* in a state that the flange portion thereof is surrounded by the protruding portions 430*a*, 430*b*. Furthermore, FIG. 7 is an enlarged view illustrating a setting situation of the notched portion 320*a* of the lower electrode 320 in particular. Note that the lower electrode 320 is aligned to only the direction designated by the arrow S1 in FIG. 7 when it is grasped by the first and second insulating support members 410*a*, 410*b*; however, it is still slightly rotatable to the direction designated by the arrow S2.

Subsequently, the upper electrode 310, as shown in FIG. 6, is disposed on the lower electrode 320 in a state that the protruding portions 430*a*, 430*b* are pinched into the slit grooves 310*a*-310*d*. At this time, the upper electrode 310, which is different from the lower electrode 320, is movable to the direction represented by the arrow S1 in FIG. 7, but cannot be rotated to the direction represented by the arrow S2. For this reason, when the fixing areas 313*a*, 313*b* provided at the outer periphery of the flange portion of the upper electrode 310 are welded at the lower electrode 320, the upper electrode 310 and lower electrode 320 are unitedly fixed (aligned) to the first and second insulating support members 410*a*, 410*b*.

Figure 8:
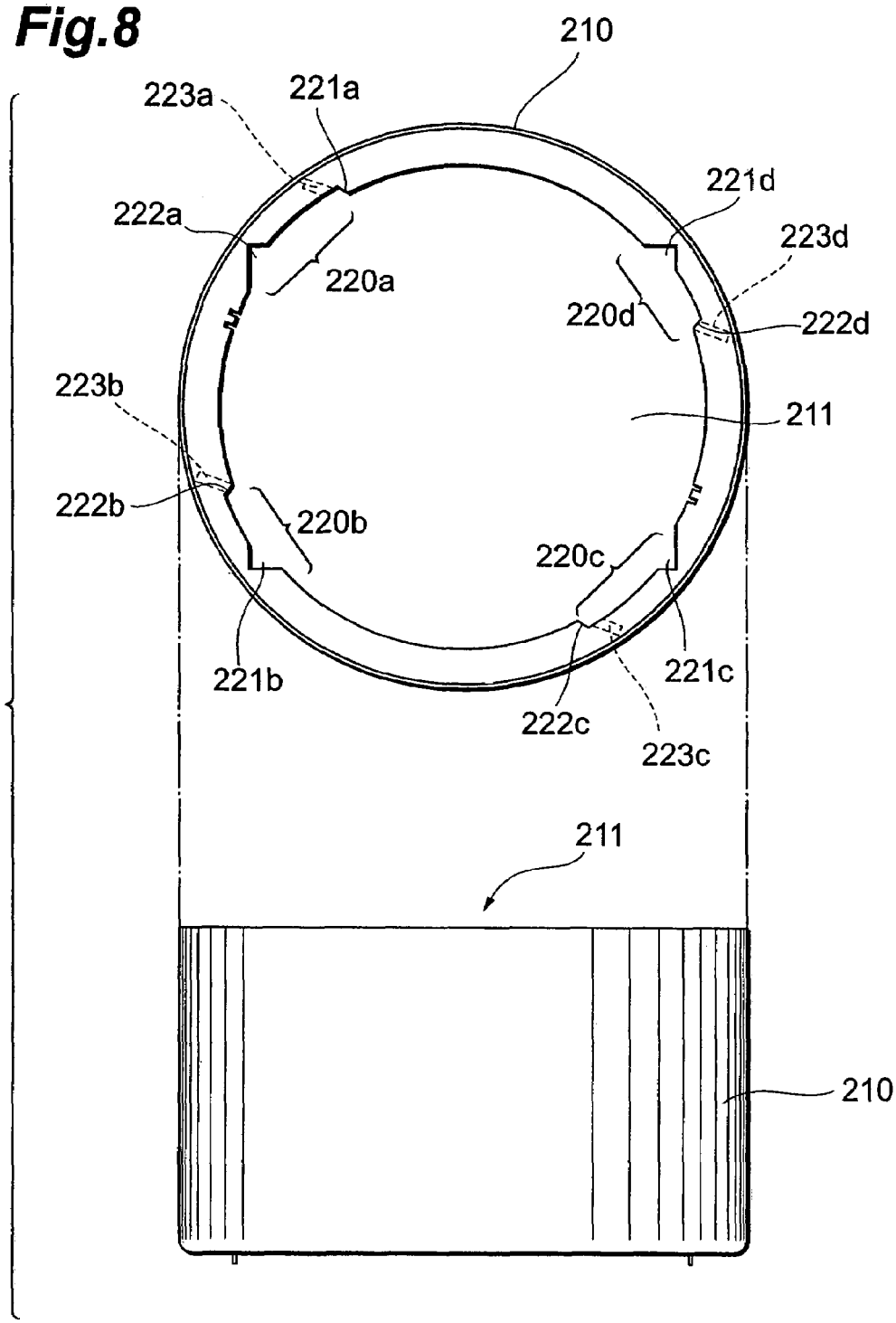
FIG. 8 is a plan view and a side view for explaining the structure of the focusing electrode.

Furthermore, FIG. 8 is a plan view and a side view for explaining the structure of the focusing electrode 200.

In particular, the focusing electrode 200 is constituted by the body unit 210 shown in FIG. 8 (substantially a main body of the focusing electrode; there are some cases that the body unit 210 herein may be simply called 'focusing electrode') and the reinforcing members 250*a*, 250*b* controlling the rotation of the body unit 210. The body unit 210, as shown in FIG. 8, has a flange portion that has a cylindrical shape, extends from one opening end of the body unit to the inside, and defines the through hole 211. At the flange portion, notched portions 220*a*-220*d* are formed to be grasped by slit grooves 432*a*, 432*b* provided at the protruding portions 430*a*, 430*b* of the first and second insulating support members 410*a*, 410*b*. Note that these notched portions 220*a*-220*d* is constituted by introducing portions 221*a*-221*d* for housing the protruding portions 430*a*, 430*b* via the through hole 211 in the focusing electrode 200, and fixing portions 222*a*-222*d* for limiting the rotation of the body unit 210 around the tube axis of the sealed container 110.

The body unit 210 having the aforementioned structure is fixed to the slit grooves 432*a*, 432*b* formed at the respective protruding portions 430*a*, 430*b* of the first and second insulating support members 410*a*, 410*b* in such a manner that the body unit 210 itself rotates around the tube axis of the sealed container 110.

Figure 9:
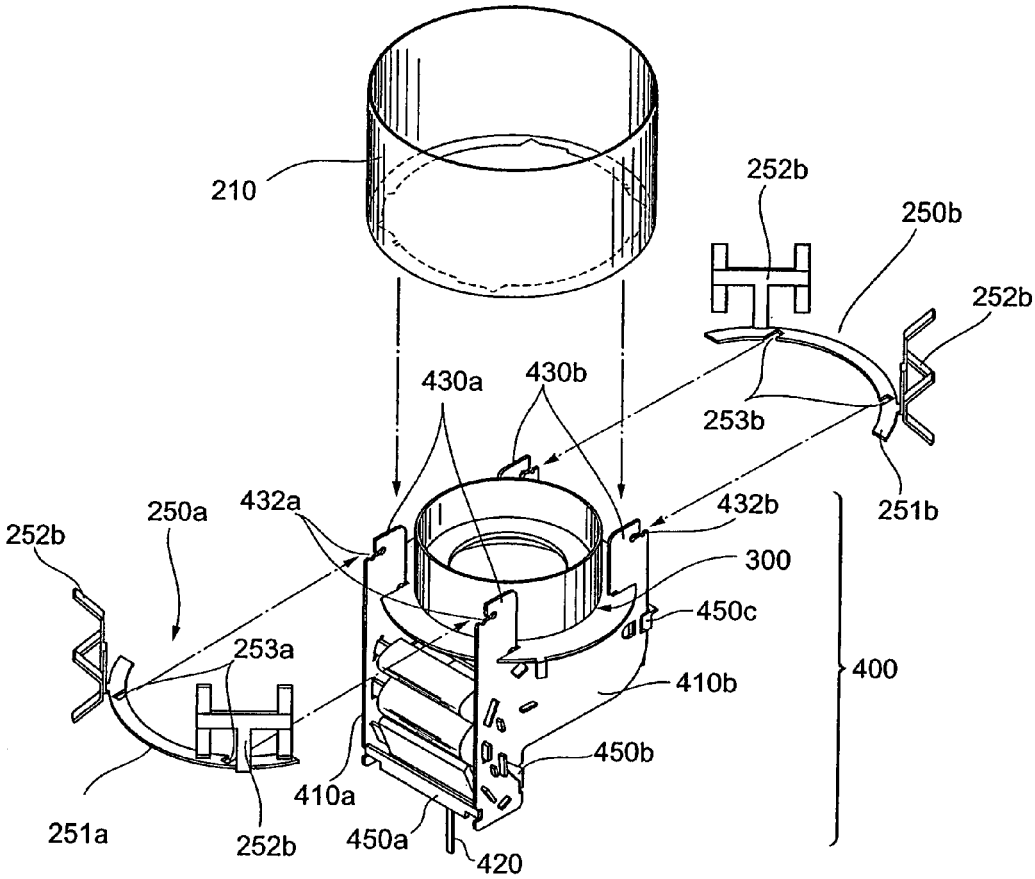
FIG. 9 is a view for explaining a mounting process of the focusing electrode to the pair of insulating support members.

Specifically, as shown in FIG. 9, the protruding portions 430*a*, 430*b* of the first and second insulating support members 410*a*, 410*b* that grasp the first to seventh dynodes DY1-DY7, anode 420, reflection-type dynode DY8, and accelerating electrode 300 are inserted into the through hole 211 of the body unit 210. The situation of this case is shown in an enlarged view of FIG. 10.

Figure 10:
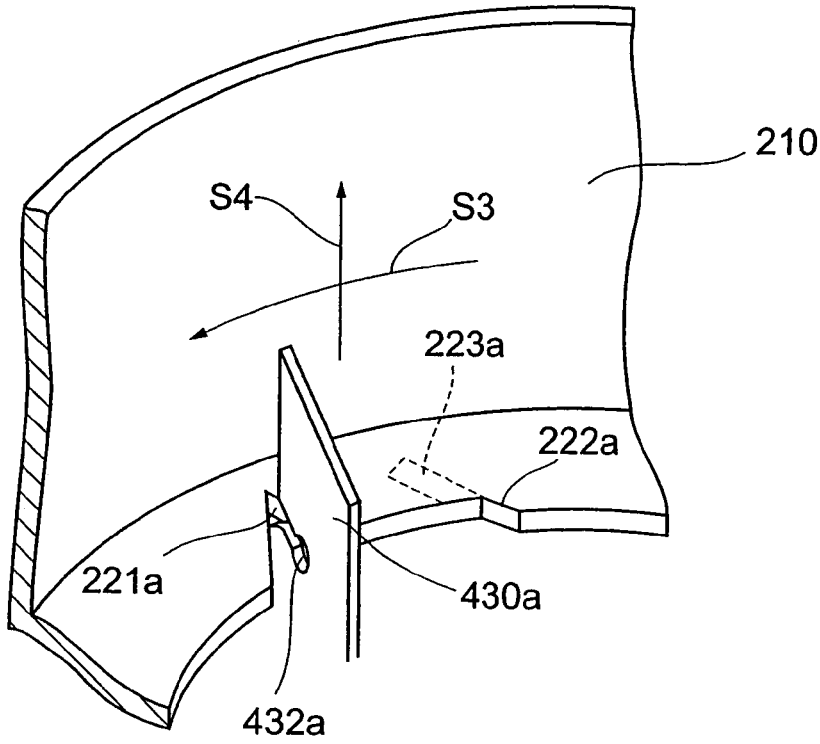
FIG. 10 is an enlarged view for explaining the mounting process of FIG. 9 in further detail.

In other words, the protruding portions 430*a*, 430*b* are inserted from the introducing portions 221*a*-221*d* in the notched portions 220*a*-220*d* along the direction designated by the arrow S4 in FIG. 10. Thereafter, the body unit 210 rotates in the direction designated by the arrow S3 shown in FIG. 10, so that the slit grooves 432*a*, 432*b* of the protruding portions 430*a*, 430*b* can abut with the fixing sections 222*a*-222*d*. At this time, the slit grooves 432*a*, 432*b* of the protruding portions 430*a*, 430*b* may grasp the areas designated by 223*a*-223*d* of the flange portion of the body unit 210. In this way, the body unit 210 itself is fixed to the direction designated by the arrow S4 in FIG. 10. However, since the body unit 210 is not fixed to the direction designated by the arrow S3, the reinforcing members 250*a*, 250*b* are fixed by welding to restrict the rotation along the direction designated by the arrow S3 of the body unit 210.

The reinforcing member 250*a* is constituted by a main body plate 251*a* abutted with the flange portion of the body unit 210 and a spring portion 252*a* abutted with the side of the body unit 210. Also, the main body plate 251*a* is provided with a slit groove 253*a* for pinching the protruding portions 430*a* of the first and second insulating members 410*a*, 410*b* arranged to oppose each other. In similar, the reinforcing member 250*b* is constituted by a main body plate 251*b* abutted with the flange portion of the body unit 210 and a spring portion 252*b* abutted with the side of the body unit 210. Also, the main body plate 251*b* is provided with a slit groove 253*b* for pinching the protruding portion 430*b* of the first and second insulating members 410*a*, 410*b* arranged to oppose each other.

Figure 11:
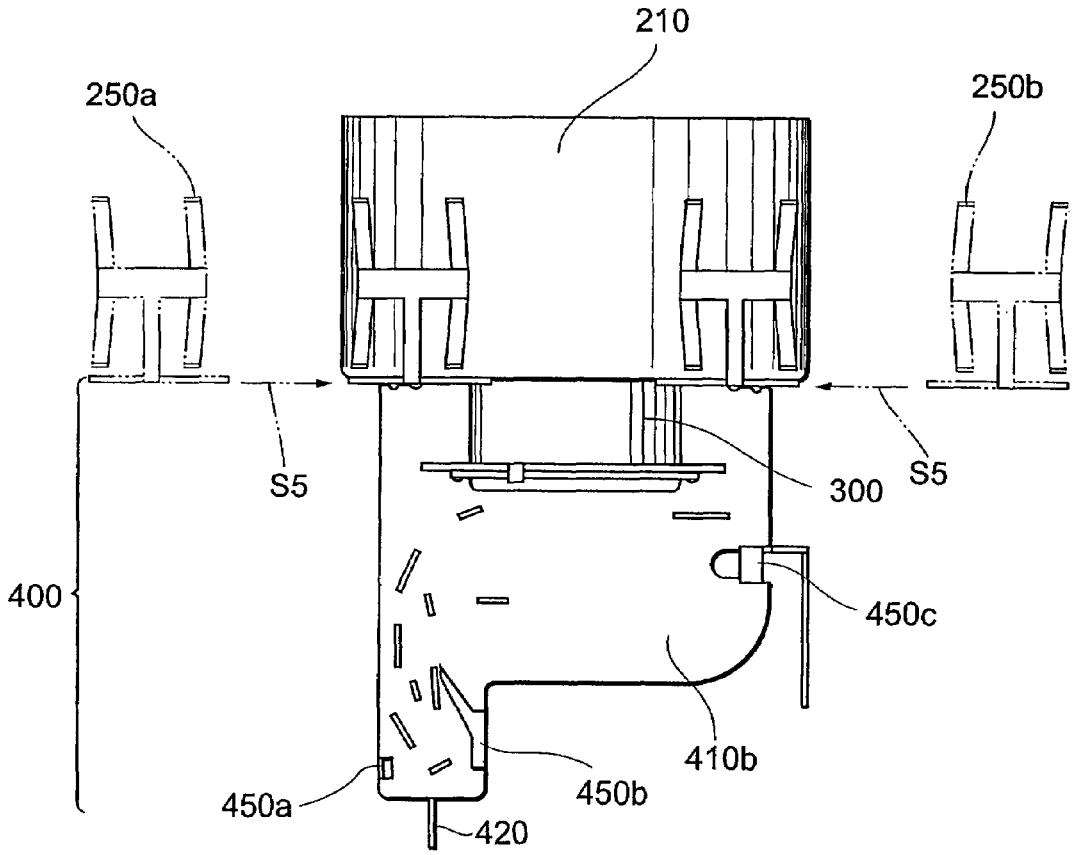
FIG. 11 is a side view illustrating an electron-multiplying unit applied to the photomultiplier according to the present invention.

These reinforcing members 250*a*, 250*b* are inserted from the direction designated by the arrow S5 in FIG. 11 (the slit grooves 253*a*, 253*b* pinching the protruding portions 430*a*, 430*b*). As described above, the body unit 210 is fixed in the direction designated by the arrow S4 in FIG. 10; however, it is not fixed in the direction designated by the arrow S3. On the other hand, the reinforcing members 250*a*, 250*b* pinch the protruding portions 430*a*, 430*b* by the slit grooves 253*a*, 253*b* to thereby be fixed in the direction designated by the arrow S3, while they are fixed in the direction designated by the arrow S4. When the above body unit 210 and each of the reinforcing members 250*a*, 250*b* are fixed by welding, the focusing electrode 200 is unitedly fixed (aligned) to the first and second insulating members 410*a*, 410*b*.

The electron-multiplying unit to be housed in the sealed container 110 through the above assembly processes.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier comprising:

a sealed container of which the inside is kept in a vacuum state;

a photocathode, accommodated in said sealed container, for emitting photoelectrons to the inside of the sealed container in response to light having a predetermined wavelength; and an electron-multiplying unit accommodated in said sealed container without being in contact with an inner wall of said sealed container, said electron-multiplying unit having:

a dynode unit accommodated in said sealed container and including a plurality of stages of dynodes for emitting secondary electrons in response to the photoelectrons reached from said photocathode to cascade-multiply sequentially the secondary electrons;

an anode, accommodated in said sealed container, for taking out the secondary electrons cascade-multiplied by said dynode unit as a signal;

a pair of insulating support members for holding unitedly said dynode unit and said anode in a state of grasping said dynode unit and said anode;

a focusing electrode arranged between said photocathode and said dynode unit, and having a through hole through which the photoelectrons from said photocathode pass, said focusing electrode for correcting an orbit of each photoelectron from said photocathode; and an accelerating electrode arranged between said focusing electrode and said dynode unit, and having a through hole through which the photoelectrons reached from said photocathode via said focusing electrode pass, said accelerating electrode for accelerating the photoelectrons reached from said photocathode via said focusing electrode, wherein said pair of insulating support members each has one or more protruding portions that extend toward said photocathode and that at least serve as a reference of the arranged position of said focusing electrode, and each of said protruding portions has a fixture structure for fixing said focusing electrode in a state of supporting directly said focusing electrode, and wherein said focusing electrode has a main body defining said through hole, and a flange portion extending from an edge portion of said main body to the tube axis of said sealed container, said flange portion being provided with one or more notched portions to be grasped by a part of each of said insulating support members when the focusing electrode itself is rotated around the tube axis of said sealed container.

2. A photomultiplier according to claim 1, wherein said notched portions are arranged so as to surround the tube axis of said sealed container.

3. A photomultiplier according to claim 1, wherein said protruding portions are respectively arranged at predetermined positions of said pair of insulating support members so as to at least surround said main body of said focusing electrode, in a state for said pair of insulating support members to grasp said dynode and said anode.

4. A photomultiplier according to claim 1, wherein said fixture structure includes a slit groove for pinching a part of said flange portion of said focusing electrode.

5. A photomultiplier according to claim 4, wherein each of said notched portions is constituted by an introducing area for accommodating said protruding portion through said through hole of said focusing electrode, and a fixing area for restricting the rotation of said focusing electrode around the tube axis of said sealed container.

6. A photomultiplier according to claim 4, wherein said focusing electrode further has one or more reinforcing members prepared with a slit groove for pinching said protruding portions, and said reinforcing members are welded to said focusing electrode in a state for the slit grooves of said reinforcing members to pinch part of said protruding portion.

* * * * *